US008091155B1

(12) United States Patent
Sanchez

(10) Patent No.: US 8,091,155 B1
(45) Date of Patent: Jan. 10, 2012

(54) SEAT LIFTING SYSTEM

(76) Inventor: Guadalupe E. Sanchez, West Sacramento, CA (US)

( * ) Notice: Subject to any disclaimer, the term of this patent is extended or adjusted under 35 U.S.C. 154(b) by 1007 days.

(21) Appl. No.: 12/028,528

(22) Filed: Feb. 8, 2008

(51) Int. Cl.
*A47K 13/10* (2006.01)

(52) U.S. Cl. ..... 4/246.1; 4/246.3

(58) Field of Classification Search ..... 4/246.1–246.5, 4/248, 234–241, 242.1
See application file for complete search history.

(56) References Cited

U.S. PATENT DOCUMENTS

| | | | | |
|---|---|---|---|---|
| 737,814 | A * | 9/1903 | Bacon | 4/246.1 |
| 752,321 | A * | 2/1904 | Bacon | 4/246.1 |
| 1,308,596 | A * | 7/1919 | Klein | 4/246.1 |
| 4,584,724 | A | 4/1986 | Wilson | |
| 4,803,741 | A | 2/1989 | Ellison | |
| D326,599 | S | 6/1992 | Callahan | |
| 5,311,619 | A * | 5/1994 | Ward | 4/246.1 |
| 5,940,896 | A | 8/1999 | Berring | |
| 6,263,517 | B1 | 7/2001 | Brooks | |
| 6,934,974 | B1 * | 8/2005 | Pantos et al. | 4/246.1 |
| 2005/0010998 | A1 | 1/2005 | Mantell | |

* cited by examiner

*Primary Examiner* — Dinh Nguyen
*Assistant Examiner* — Justin Jonaitis

(57) ABSTRACT

A seat lifting system includes a toilet and a seat and a lid, which are hingedly coupled together by a hinge and secured to the toilet so that each of the seat and lid are positionable in lifted position or lowered position relative to the toilet. A pivot bar is rotatably coupled to the seat and the lid adjacent to the hinge. A lifting arm is coupled to a first end of the pivot bar. The lifting arm extends outwardly from the pivot bar and engages a bottom face of the seat. The lifting arm lifts the seat when the pivot bar is rotated. A lifting assembly is coupled to the pivot bar and is actuated to rotate the pivot bar to lift the seat of the toilet. The lifting assembly is actuated again to rotate the pivot bar to lower the seat of the toilet.

5 Claims, 5 Drawing Sheets

SEAT LIFTING SYSTEM

BACKGROUND OF THE INVENTION

1. Field of the Invention

The present invention relates to toilet seat manipulation devices and more particularly pertains to a new toilet seat manipulation device for lifting a lid and a seat of a toilet at the same time and securing the lid and the seat in a raised position.

2. Description of the Prior Art

The use of toilet seat manipulation devices is known in the prior art. While these devices fulfill their respective, particular objectives and requirements, the need remains for a system that has certain improved features that allow for a lid and a seat to be raised in single motion. Additionally, the system should include a biasing member to decelerate the lowering of the seat of the toilet.

SUMMARY OF THE INVENTION

The present invention meets the needs presented above by generally comprising a toilet. A seat and a lid are hingedly coupled together by a hinge and secured to the toilet so that each of the seat and lid are positionable in lifted position or lowered position relative to the toilet. A pivot bar is rotatably coupled to the seat and the lid adjacent to the hinge. A lifting arm is coupled to a first end of the pivot bar. The lifting arm extends outwardly from the pivot bar and engages a bottom face of the seat. The lifting arm lifts the seat when the pivot bar is rotated. A lifting assembly is coupled to the pivot bar and is actuated to rotate the pivot bar to lift the seat of the toilet. The lifting assembly is actuated again to rotate the pivot bar to lower the seat of the toilet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
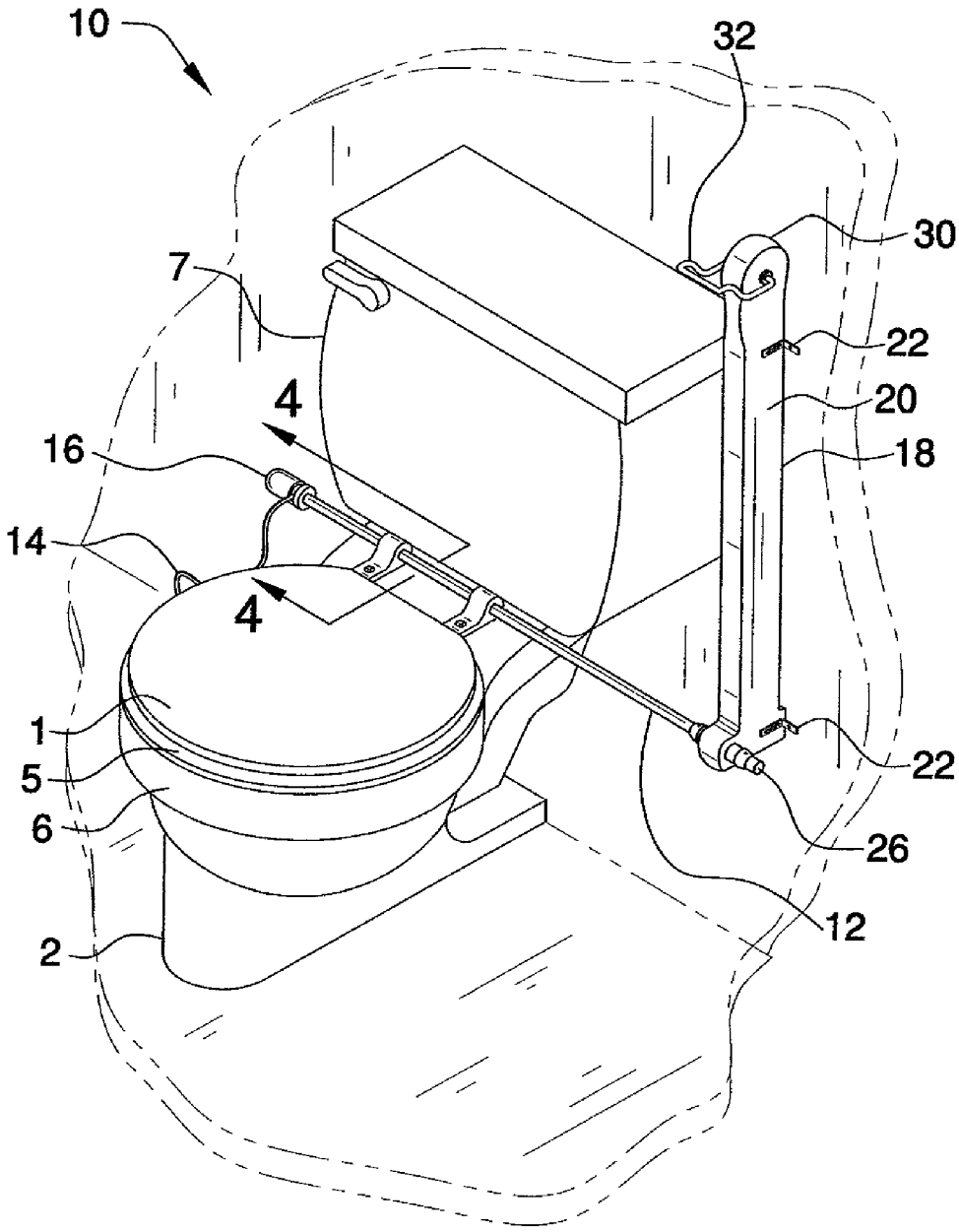
FIG. 1 is a perspective view of a seat lifting system according to the present invention in place on a toilet.
Figure 2:
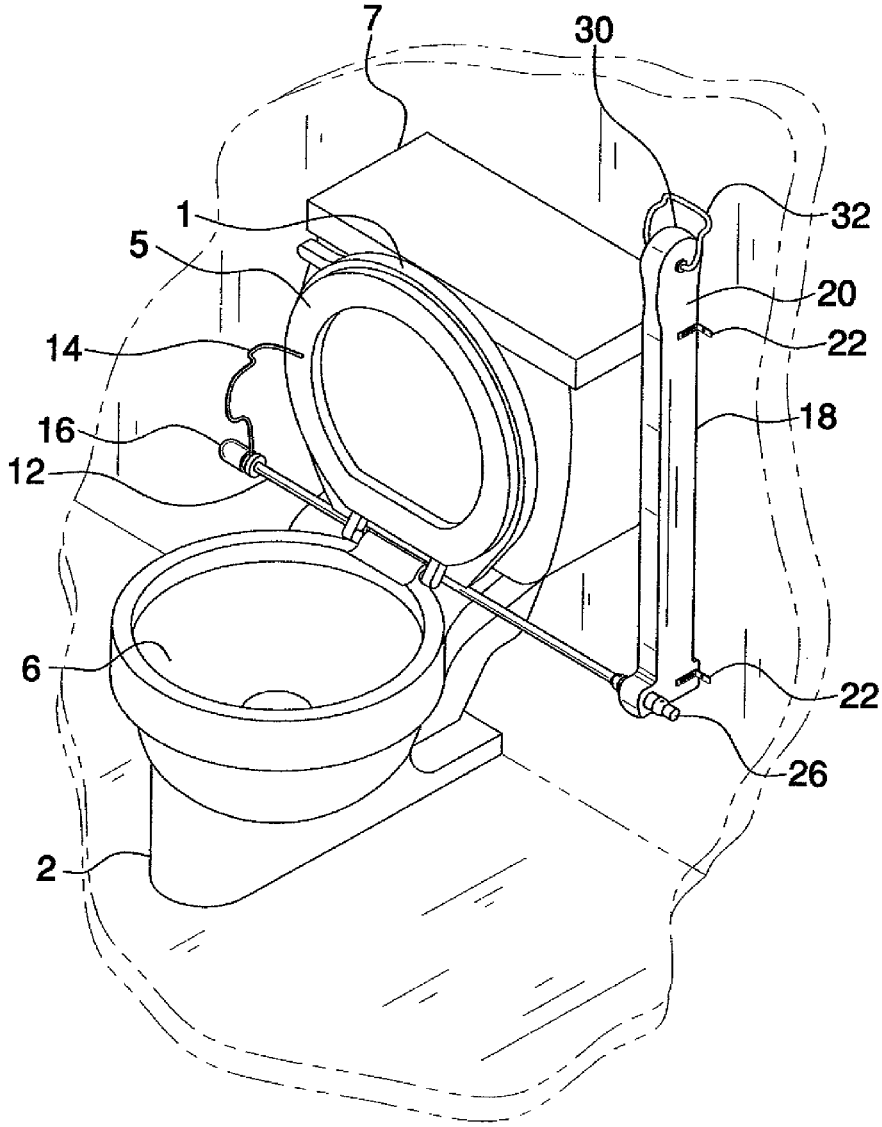
FIG. 2 is a perspective view of the present invention shown actuated to lift the seat and the lid of the toilet.
Figure 3:
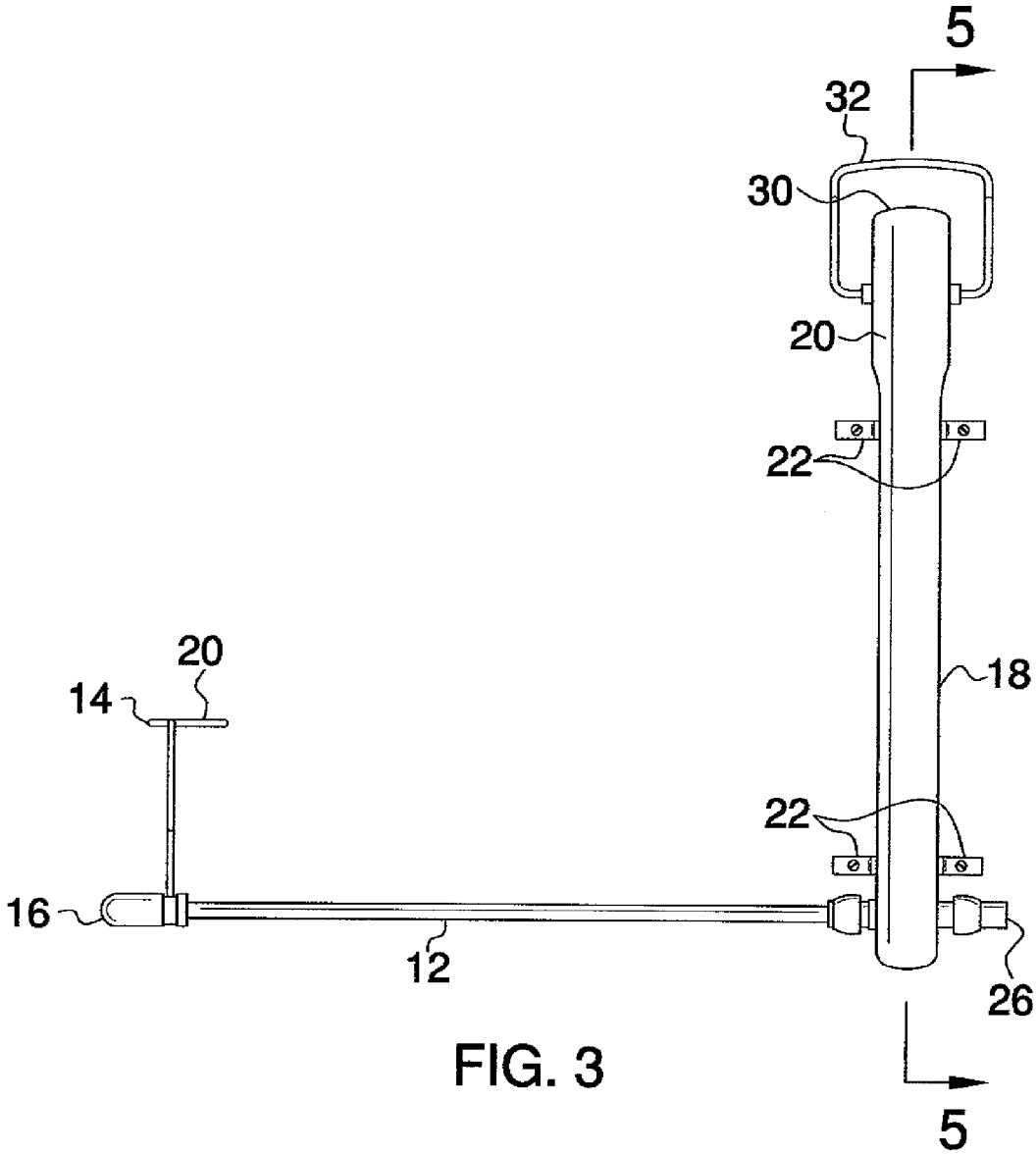
FIG. 3 is a front view of the present invention with the lifting arm raised and without a seat, lid and hinge of a toilet.
Figure 4:
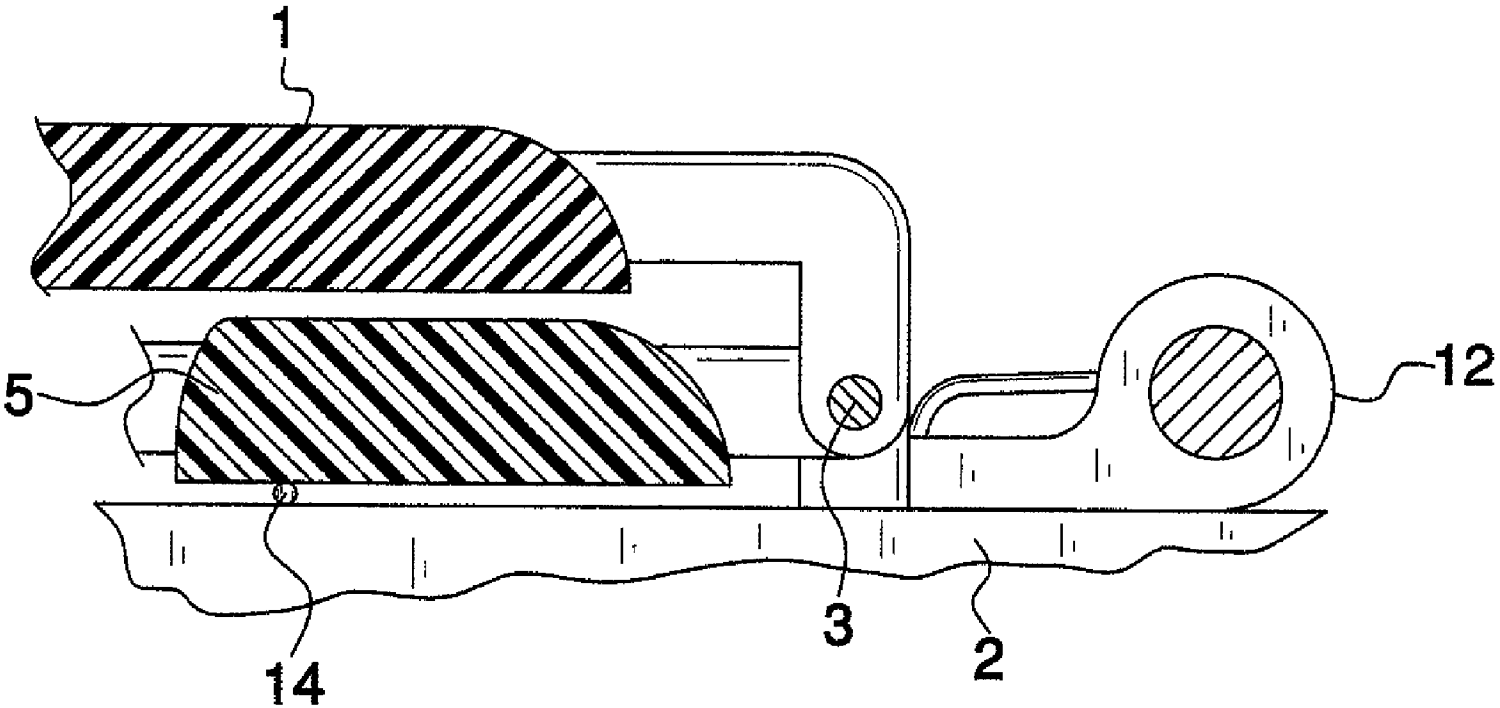
FIG. 4 is a cross-sectional view of the present invention taken along line 4-4 of FIG. 1.
Figure 5:
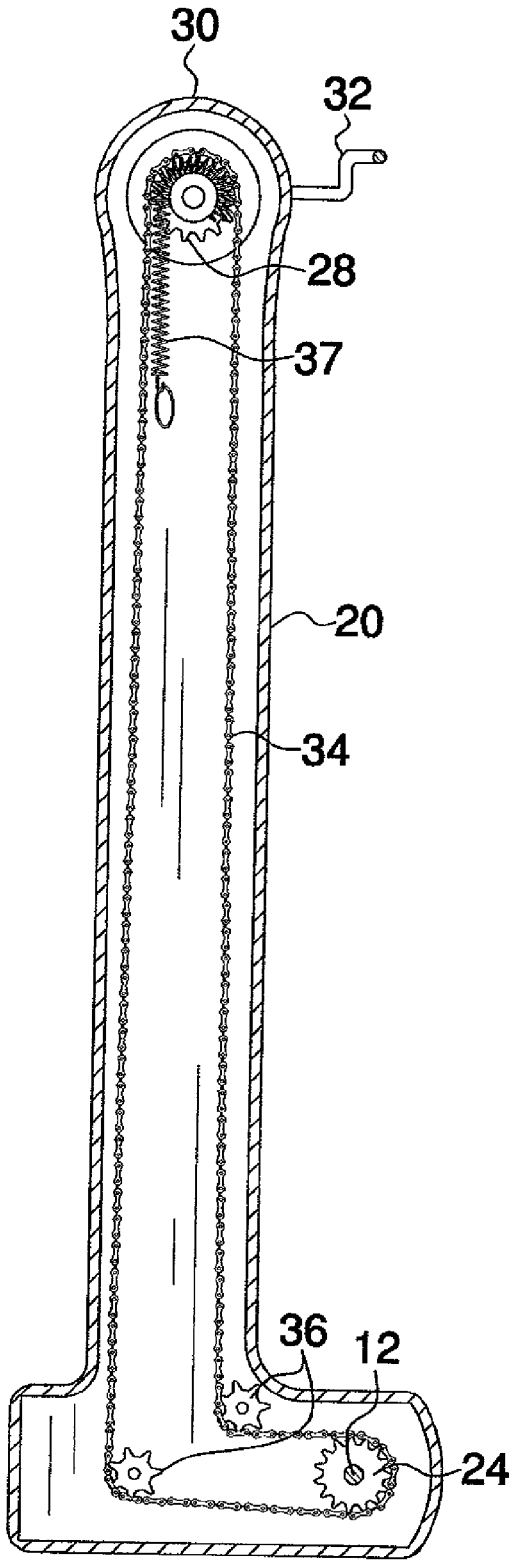
FIG. 5 is a cross-sectional view of the present invention taken along line 5-5 of FIG. 3.

With reference now to the drawings, and in particular to FIGS. 1 through 5 thereof, a new toilet seat manipulation device embodying the principles and concepts of the present invention and generally designated by the reference numeral 10 will be described.

As best illustrated in FIGS. 1 through 5, the seat lifting system 10 generally comprises a toilet 2 having a lid 1 and seat 5 hingedly coupled thereto, and to each other, by a hinge 3. The seat 5 and lid 1 are selectively positionable in a lifted position or in a closed position relative to the toilet in a conventional manner. A pivot bar 12 is rotatably coupled to the seat 5 and lid 1 adjacent to the hinge 3. A lifting arm 14 is coupled to a first end 16 of the pivot bar 12. The lifting arm 14 extends outwardly from the pivot bar 12 and engages, and may be mounted to, a bottom face 4 of a seat 5. The lifting arm 14 lifts the seat 5 when the pivot bar 12 is rotated. The lifting arm 14 is approximately hook shaped.

A lifting assembly 18 is coupled to the pivot bar 12. The lifting assembly 18 is actuated to rotate the pivot bar 12 to lift the seat 5 of the toilet 2. The lifting assembly 18 is actuated again to rotate the pivot bar 12 to lower the seat 5 of the toilet 2. The lifting assembly 18 includes a housing 20 coupled to a wall positioned adjacent to a tank 7 of the toilet 2. A plurality of mounting brackets 22 is slidably coupled to the housing 20. The mounting brackets 22 are mounted to the wall to mount the housing 20 to wall. The housing 20 can be slid with respect to the mounting brackets 22 to permit optimal positioning of the housing 20. A lifting gear 24 is rotatably coupled to and positioned in the housing 20. The lifting gear 24 is coupled to a second end 26 of the pivot bar 12.

The lifting assembly 18 also includes an actuation gear 28 rotatably coupled to and positioned in the housing 20. The actuation gear 28 is positioned adjacent a top end 30 of the housing 20. A handle 32 extends through the housing 20 and is coupled to the actuation gear 28. The handle 32 is lifted upwardly to rotate the actuation gear 28 in a first direction. The handle 32 is lowered to rotate the actuation gear 28 in a second direction. A chain 34 extends around the actuation gear 28 and the lifting gear 24. The chain 34 transfers rotational movement of the actuation gear 28 to the lifting gear 24. The lifting gear 24 rotates the pivot rod to lift the seat 5 when the actuation gear 28 is rotated in the first direction. The lifting gear 24 rotates the pivot rod to lower the seat 5 when the actuation gear 28 is rotated in the second direction. A plurality of sprockets 36 are rotatably coupled to and positioned in the housing 20. The chain 34 runs over the sprockets 36 to allow the chain 34 to extend around corners without rubbing on the housing 20.

The lifting assembly 18 additionally includes a biasing member 37 coupled to and positioned in the housing 20. The biasing member 37 is coupled to the actuation gear 28 and extends between the housing 20 and the actuation gear 28. The biasing member 37 biases the actuation gear 28 to rotate in the first direction when the handle 32 is lifted. The biasing member 37 resists rotation of the actuation gear 28 in the second direction to decelerate the lowering of the seat 5 when the handle 32 is lowered.

In use, the handle 32 is lifted upwardly and the chain 34 transfers rotational movement the actuation gear 28 to the lifting gear 24. The lifting gear 24 rotates the pivot rod to lift the seat 5. To the lower the seat 5 the handle 32 is lowered from the raised position to rotate the actuation gear 28 in the second direction and thereby rotate the lifting gear 24 to rotate the pivot rod in the opposite direction and lower the seat 5.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat lifting system comprising:

a toilet;

a seat and a lid being hingedly coupled together by a hinge and secured to said toilet, each of said seat and lid being positionable in lifted position or lowered position relative to said toilet;

a pivot bar being rotatably coupled to said seat and said lid, said pivot bar being positioned adjacent to said hinge;

a lifting arm being coupled to a first end of said pivot bar, said lifting arm extending outwardly from said pivot bar and engaging a bottom face of the seat, said lifting arm lifting the seat when said pivot bar is rotated;

a lifting assembly being coupled to said pivot bar, said lifting assembly being actuated to rotate said pivot bar to lift the seat of the toilet, said lifting assembly being actuated again to rotate said pivot bar to lower the seat of the toilet;

wherein said lifting assembly includes;

a housing being coupled to a wall positioned adjacent to the toilet;

a lifting gear being rotatably coupled to and positioned in said housing, said lifting gear being coupled to a second end of said pivot bar;

an actuation gear being rotatably coupled to and positioned in said housing; and a chain extending around said actuation gear and said lifting gear, said chain transferring rotational movement of said actuation gear to said lifting gear, said lifting gear rotating said pivot rod to lift the seat when said actuation gear is rotated in the first direction, said lifting gear rotating said pivot rod to lower the seat when said actuation gear is rotated in the second direction.

2. The system according to claim 1, wherein said actuation gear is positioned adjacent a top end of said housing.

3. The system according to claim 1, wherein said lifting assembly includes a handle extending through said housing and being coupled to said actuation gear, said handle being lifted upwardly to rotate said actuation gear in a first direction, said handle being lowered to rotate said actuation gear in a second direction.

4. The system according to claim 1, wherein said lifting assembly includes a biasing member being coupled to and positioned in said housing, said biasing member being coupled to said actuation gear and extending between said housing and said actuation gear, said biasing member biasing said actuation gear to rotate in the first direction when said handle is lifted, said biasing member resisting rotation of said actuation gear in the second direction to decelerate the lowering of the seat when the handle is lowered.

5. A toilet seat lifting system comprising:

a toilet;

a seat and a lid being hingedly coupled together by a hinge and secured to said toilet, each of said seat and lid being positionable in lifted position or lowered position relative to said toilet;

a pivot bar being rotatably coupled to said seat and said lid, said pivot bar being positioned adjacent to said hinge;

a lifting arm being coupled to a first end of said pivot bar, said lifting arm extending outwardly from said pivot bar and engaging a bottom face of the seat, said lifting arm lifting the seat when said pivot bar is rotated;

a lifting assembly being coupled to said pivot bar, said lifting assembly being actuated to rotate said pivot bar to lift the seat of the toilet, said lifting assembly being actuated again to rotate said pivot bar to lower the seat of the toilet, said lifting assembly comprising:

a housing being coupled to a wall positioned adjacent to the toilet;

a lifting gear being rotatably coupled to and positioned in said housing, said lifting gear being coupled to a second end of said pivot bar;

an actuation gear being rotatably coupled to and positioned in said housing, said actuation gear being positioned adjacent a top end of said housing;

a handle extending through said housing and being coupled to said actuation gear, said handle being lifted upwardly to rotate said actuation gear in a first direction, said handle being lowered to rotate said actuation gear in a second direction;

a chain extending around said actuation gear and said lifting gear, said chain transferring rotational movement of said actuation gear to said lifting gear, said lifting gear rotating said pivot rod to lift the seat when said actuation gear is rotated in the first direction, said lifting gear rotating said pivot rod to lower the seat when said actuation gear is rotated in the second direction; and a biasing member being coupled to and positioned in said housing, said biasing member being coupled to said actuation gear and extending between said housing and said actuation gear, said biasing member biasing said actuation gear to rotate in the first direction when said handle is lifted, said biasing member resisting rotation of said actuation gear in the second direction to decelerate the lowering of the seat when the handle is lowered.

* * * * *